United States Patent [19]

Flaherty

[11] 4,214,707

[45] Jul. 29, 1980

[54] TRAP-PORT FOR ROTARY KILNS

[75] Inventor: Thomas W. Flaherty, Waukesha, Wis.

[73] Assignee: Allis-Chalmers Corporation, Milwaukee, Wis.

[21] Appl. No.: 59,908

[22] Filed: Jul. 23, 1979

[51] Int. Cl.[2] ..... B05B 1/14

[52] U.S. Cl. ..... 239/553.5; 239/600; 266/173

[58] Field of Search ..... 239/112, 106, 104, 491, 239/492, 78, 600, 553.5; 266/173; 432/105, 109

[56] References Cited

U.S. PATENT DOCUMENTS

| | | | |
|---|---|---|---|
| 2,304,456 | 12/1942 | Hall | 239/106 |
| 3,198,235 | 8/1965 | Haskell | 239/78 X |
| 3,221,996 | 12/1965 | Emmert et al. | 239/553.5 |
| 3,794,483 | 2/1974 | Rossi | 266/173 X |
| 3,946,949 | 3/1976 | Rossi | 239/600 |

*Primary Examiner*—Robert B. Reeves
*Assistant Examiner*—Gene A. Church
*Attorney, Agent, or Firm*—Robert C. Jones

[57] ABSTRACT

A labyrinth port structure minimizes entrapment of fine particulates in the port piping of a rotary kiln and maintains a self-flushing operation which permits turbulent mixing resulting in particulate removal from port cavities.

7 Claims, 5 Drawing Figures

TRAP-PORT FOR ROTARY KILNS

BACKGROUND OF THE INVENTION

The invention relates to rotary kilns and particularly to the ports for delivering gas and air to the interior of a rotary kiln wherein the port is self-purging.

In the prior art, rotary kilns are known wherein a plurality of ports are provided through the shell of the kiln to admit air and/or fuel into the interior of the kiln.

Examples of such prior art are disclosed in U.S. Pat. Nos. 1,216,667; 2,091,850; 3,182,980; 3,198,235; 3,794,483 and 3,946,949.

In the prior art, kiln fuel and/or air is injected into the kiln through ports while the ports are above the material charge of the bed. Alternately, injection may be accomplished when the ports are beneath the bed of the material charge which consists of fines and larger size particles. Under this condition, the fines and smaller particles enter the ports and associated piping impairing the flow of fluid through the port and eventually causing complete clogging of the port, rendering it useless for under bed fluid injection. It is not unusual to have as many as 300 nozzles in a rotary kiln of 150 foot size. Thus, when a number of ports become useless by reason of being plugged, the efficiency of the kiln is reduced and its operational time span between maintenance periods is reduced, thereby increasing the cost factor. Furthermore, the ports are exposed to extremely high temperatures. While fluid is flowing through a port, the fluid itself has a tendency to cool the port. However, when no fluid flows through the port, the port and associated structure approaches the temperature within the kiln, thereby reducing the effective active life of the port.

It is therefore the general object of the present invention to provide a trap-port construction for a rotary kiln which is self-purging.

Another object of the present invention is to provide a trap-port construction which includes a labyrinth trap design that permits turbulent mixing with resultant particle removal from the port cavities.

Still another object of the present invention is to provide a trap-port construction which minimizes entrapment of fine particulate in the port piping of a rotary kiln.

SUMMARY OF THE INVENTION

In accordance with the present invention, there is provided a trap-port including a nozzle having a plurality of orifices, preferably of about one-quarter of an inch in diameter. Behind the nozzle is a cup-like member presenting a concentrically arranged circular barrier into which a fluid is admitted. The cup-like member is arranged to abut the back surface of the nozzle at the peripheral edge thereof. The circular barrier extends from the bottom of the cup member to a point short of the back surface of the nozzle, thereby defining a fluid flow gap. The barrier, in conjunction with the wall of the cup member, defines a particulate chamber in which the particulate entering through the nozzle orifices is trapped. The interior of the circular barrier defines a fluid chamber in which fluid is supplied. The barrier has a plurality of openings formed in its cylindrical wall through which a portion of the fluid supplied to the chamber is diverted into the particulate chamber. This diverted fluid provides a turbulent mixing of the particulate with the fluid and with particulates being carried by the fluid out through the nozzle orifices. Fluid flowing over the fluid flow gap defined by the rim of the barrier reinforces the turbulent mixing occurring through the barrier wall openings.

DESCRIPTION OF THE INVENTION

Figure 1:
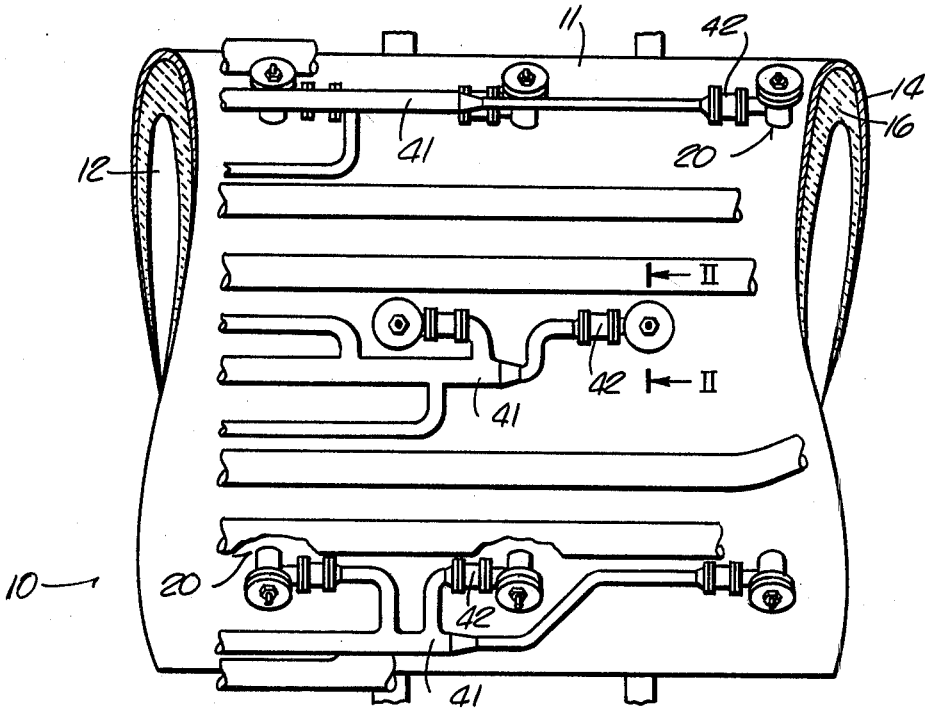
FIG. 1 is a side view of a portion of a rotary kiln having a plurality of trap-ports in accordance with the invention.

The kiln 10 shown in FIG. 1 is provided with an elongated cylindrical body portion 11 which defines a cylindrical chamber 12. The body portion 11 of the kiln comprises an outer steel shell 14 which is lined with a suitable refractory material 16, such as fire bricks. Any well known means may be provided for supporting and rotating the kiln. Since such means form no part of the present invention and are well known in the art, they are not shown herein.

Figure 2:
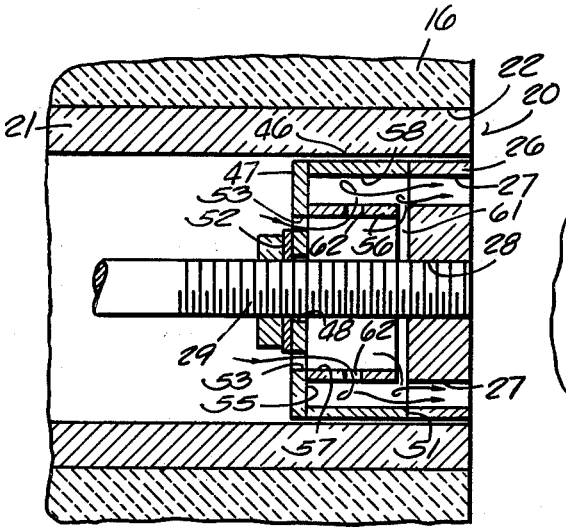
FIG. 2 is a section through a trap-port in the kiln wall taken in a plane represented by the line II—II in FIG. 1.

A plurality of circumferentially and axially spaced nozzles 20 are provided about the surface of the kiln opening into the chamber 12. The nozzles 20 are all similar in construction and operation, and a description of one of said nozzles will apply to all of the nozzles. As shown in FIG. 2, the nozzle 20 is disposed within a cylindrical steel sleeve or port pipe 21 which is fixed within a suitable opening 22 formed in the wall of the kiln. Within the port pipe 21, the nozzle 20 is supported to effect a desired positioning of the nozzle inner face with respect to the inner surface of the refractory walls.

Figure 3:
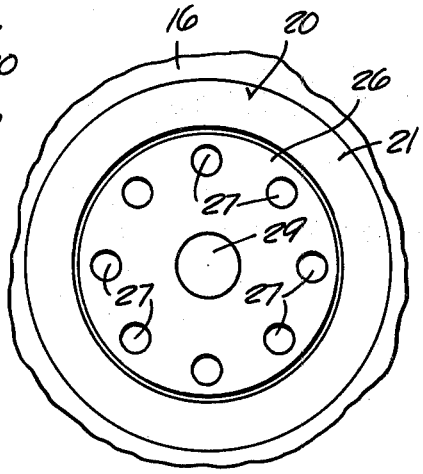
FIG. 3 is a front view of the nozzle structure.
Figure 4:
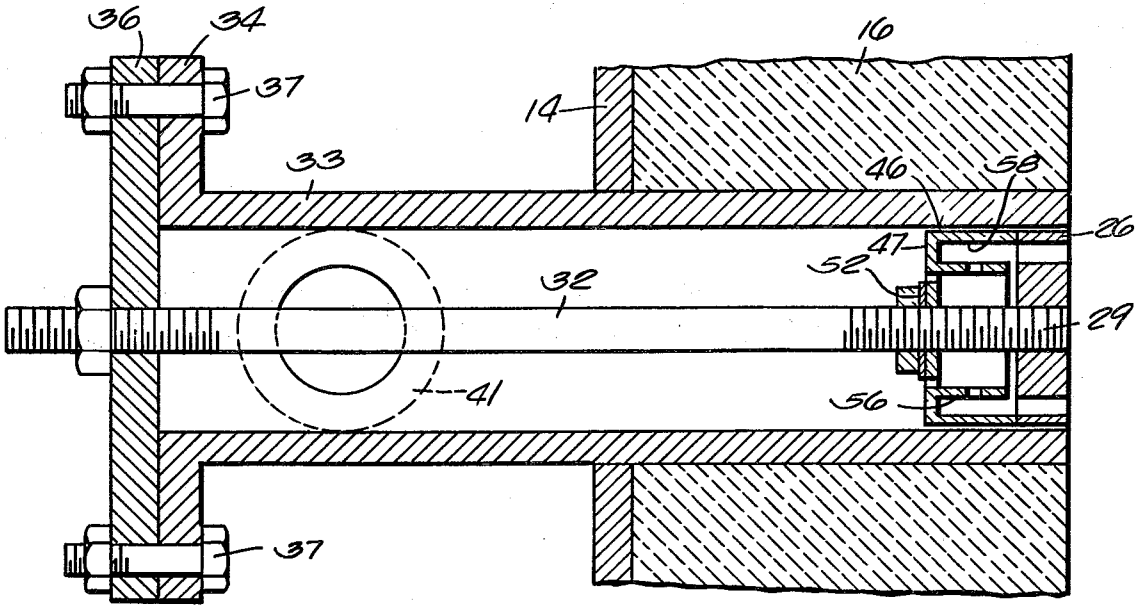
FIG. 4 is an enlarged view in section through a trap-port.

As shown in FIGS. 2 and 3 the nozzle 20 includes an orifice plate 26 having a plurality of openings 27 for directing fluid under pressure into the chamber 12 of the kiln. As shown, the openings 27 are formed in a spaced apart circular array adjacent the peripheral edge of the orifice plate and are sized to prevent plugging by particulates and slag. The plate 26 has an axial threaded opening 28 which receives a threaded shaft 29. At its opposite or outer end, the shaft 29 extends outwardly of the port pipe 21, as shown in FIG. 4, which has a radial flange portion 34 and threadedly engages in a closure gap 36. Cap 36 is secure to the flange 34 by screws 37.

Fluid is supplied selectively to the nozzles 20 by supply pipes 41, FIG. 1, connected into port pipes 21 and to a source of fluid. Individual valve means 42 are shown associated with each port. It will be appreciated that any other distribution and control means may be employed for selectively supplying fluid to the arrangement of port 20 as may be desired.

As the kiln 10 rotates, clean port structure rotates under the bed of material (not shown) within the kiln chamber 12. Before the fluid under pressure is turned on to the ports under the material bed, fines of the particulate enter the openings 27 of the nozzle and enter the port piping. To eliminate this condition, the nozzle 20 is provided with a labyrinth cup 46 FIG. 2, which traps particulates which enter through the nozzle orifices 27, FIGS. 2 and 3. The particulates which are entrapped in the labyrinth of cup 46 are blown back out through the nozzle into the kiln chamber 12 after the fluid under pressure is turned on to the port. The labyrinth cup 46 is self-flushing, providing for a turbulent mixing of the entrapped particulates with the fluid, so that the particulates flow out with the fluid through the nozzle orifices 27.

To this purpose, the labyrinth cup 46 comprises an annular disc-like member 47 having an axial opening 48, FIG. 2, through which the shaft 29 passes freely. The peripheral edge 51 of the cup 46 abuts the adjacent surface of the orifice plate 26 outwardly of the orifices 27 so as not to interfere with the fluid flow through the orifices. Suitable securing means such as a nut 52 threaded on the shaft 29 in tight engagement with the labyrinth cup 46 secures the labyrinth cup 46 in position against the orifice plate 26. A plurality of fluid entrance openings 53 (in this particular arrangement there are twelve openings, two of which are shown in FIG. 2) are formed in the bottom surface 55 of the cup member 46 in spaced apart relationship and in a circle around the axis of the cup. A circular barrier 56 is attached to the bottom of the cup member 46. The diameter of the barrier is such as to permit centering of the barrier within the cup member 46 and locating it outside of the circle of openings 53. Thus, the barrier 56 defines an inner chamber 57 and a particulate entrapment chamber 58. As shown, the barrier 56 is sized in axial length so as not to engage against the adjacent surface of the orifice plate 26, thereby providing a fluid flow gap 61. The barrier 56 is provided with a plurality of openings 62 which are spaced equi-distant apart.

With the arrangement described, the fluid under pressure enters the chamber 57 through openings 53 of the labyrinth cup member 46. The fluid in chamber 57 then divides, some of it flowing out through the barrier openings 62 into the particulate chamber 58. The diverted fluid is caused to swirl in the chamber 58 by reason of the abrupt change in the flow path and also by reason of the fluid impinging the wall surface of the chamber. This swirling action provides the right turbulent mixing action required to pick up the particulates from the chamber 58. The other portion of the fluid impinges the surface of the orifice plate 26 and is diverted out through the circular flow gap 61 into the portion of the particulate chamber 58 to the right of the openings 62, as viewed in FIG. 2, where it mixes with the particulate laden fluid from the bottom of the chamber 58. It has been found that for a 4¼ inch diameter nozzle structure a fluid flow gap 61 of 1/16 of an inch in combination with twelve ⅛ inch openings 62 results in a flow area which provides a pressure drop that gives the desired turbulent mixing of the particulates with the fluid.

Figure 5:
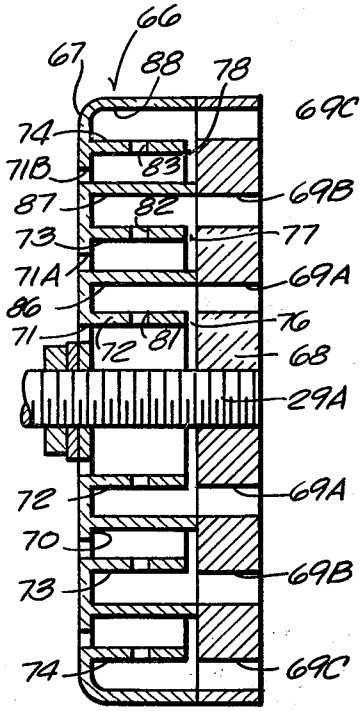
FIG. 5 is a modification of the invention disclosed in FIG. 2 showing a multichamber labyrinth trap-port arrangement for larger size nozzles.

While a single labyrinth cup structure has been disclosed, a multi-labyrinth arrangement is possible for larger diameter nozzles. One such multi-labyrinth arrangement 66 is shown in FIG. 5. As shown, there is provided a cup-like member 67 having an axial opening which receives the threaded shaft 29A. One end of the shaft 29A is secured in a circular orifice plate 68. The member 67 may be secured to the orifice plate 68 using any suitable method. Constructed in the orifice plate 68 are three concentric circles of spaced apart orifices 69A, 69B and 69C. The shaft 29A operates in the same manner as the shaft 29 previously described. Formed in the bottom surface 70 of the cup member 67 is a plurality of concentrically arranged openings 71, 71A and 71B. The openings 71, 71A and 71B serve the same purpose as the opening 53 in the single member 47. Arranged in concentric relationship are three barrier members 72, 73 and 74 which extend from the bottom surface of the cup member 67 to a point short of the orifice plate 68 so as to form fluid flow gaps 76, 77 and 78 which operate in the manner of the fluid flow gap 61 associated with the single labyrinth arrangement.

Each of the barriers 72, 73 and 74 have a plurality of openings 81, 82 and 83 respectively formed therein which provided for the diverted flow of a portion of the fluid supplied to the openings 71, 71A and 71B. Thus, the action of the fluid in each particulate chamber 86, 87 and 88 has the same action as that which occurs with the single labyrinth chamber 58. In each instance, the flow area must be evaluated to obtain the flow characteristics and pressure drops necessary for desired turbulent mixing of the fluid and particulate.

The embodiments of the invention in which an exclusive property or privilege is claimed are defined as follows:

1. A nozzle for supplying fluid to a rotary kiln having a hollow sleeve structure adapted to extend through the kiln wall from the exterior thereof into communication with the interior of the kiln;

a nozzle having an axis disposed in said sleeve adjacent the interior of the kiln;

a plurality of orifices formed in said nozzle with their axes disposed in planes parallel to the axis of said nozzle;

a labyrinth member secured to said nozzle on the side thereof remote from the interior of the kiln for entrapping particulates that enter through said orifices;

means formed in said labyrinth member to permit entry of a fluid; and, means within said labyrinth to effect turbulent mixing of the fluid admitted to said labyrinth member with particulate material that enters the labyrinth member through the orifices of said nozzle;

whereby the particulate material is carried out of the labyrinth member by the fluid through said nozzle and into the kiln.

2. A nozzle according to claim 1 wherein said means within said labyrinth includes a fluid flow diverter operable to deflect the flow of the fluid which effects turbulent mixing of the fluid with the particulates entrapped within said labyrinth so that the particulates are carried by said fluid out through said nozzle.

3. A nozzle according to claim 2 wherein said fluid flow diverter is operable to effect at least one 90 degree change in the flow path of the fluid entering said labyrinth member.

4. A nozzle according to claim 3 wherein said fluid flow diverter is also operable to provide a second fluid flow path for the fluid to effect a second turbulent fluid flow stream which combines with the other turbulent fluid flow stream to reinforce the first particulate laden fluid flow stream.

5. A nozzle for supplying fluid to the interior chamber of a rotary kiln, said kiln having a sleeve adapted to extend through the kiln wall from the exterior thereof into communication with the chamber of the rotary kiln;

a nozzle having an axis supported within said sleeve adjacent to the chamber of the kiln;

a plurality of orifices formed in said nozzle having their axes in planes parallel to the axis of said nozzles;

a particulate trap cup having a base secured abutting relationship to said nozzle on the side thereof remote from the kiln chamber;

a plurality of openings formed in the base of said trap cup to provide an entry for fluid to enter said trap cup;

a barrier extending from the base of said trap cup toward said nozzle, said barrier encompassing the openings formed in the base of said trap cup; said barrier serving to define an internal chamber for receiving fluid via said openings and a particulate trap chamber wherein particulates entering through the orifices of said nozzle are collected, said particulate trap chamber being in communication with said orifices; and, a plurality of fluid flow openings in said barrier operable to direct fluid from the internal chamber in which fluid is received into the particulate collecting chamber to provide for turbulent mixing of the particulates with the fluid and to be carried thereby out through said nozzle orifices into the kiln chamber.

6. A nozzle according to claim 5 wherein said barrier extends from the base of said trap cup to a point short of said nozzle to define a fluid flow gap therebetween wherein a portion of the fluid entering said internal chamber flows through said gap to combine with the particulate laden turbulent fluid from the particulate trap chamber.

7. A nozzle according to claim 6 wherein the combined flow area defined by said barrier openings and said flow gap provide a pressure drop to create the desired turbulent mixing of the particulates with the fluid.

* * * * *